United States Patent [19]

Sato et al.

[11] Patent Number: 4,907,210

[45] Date of Patent: Mar. 6, 1990

[54] TRAIN WHEEL OF ELECTRONIC TIMEPIECE

[75] Inventors: Mamoru Sato; Mamoru Watanabe, both of Tokyo, Japan

[73] Assignee: Seiko Instruments Inc., Tokyo, Japan

[21] Appl. No.: 278,832

[22] Filed: Dec. 1, 1988

[30] Foreign Application Priority Data

Dec. 2, 1987 [JP] Japan ..... 62-183941[U]

[51] Int. Cl.[4] ..... G04B 19/04; G04B 19/02

[52] U.S. Cl. ..... 368/80; 368/220

[58] Field of Search ..... 368/76, 80, 157, 160, 368/220, 223, 322, 323

[56] References Cited

U.S. PATENT DOCUMENTS

| | | | |
|---|---|---|---|
| 4,074,517 | 2/1978 | Tatsumi et al. | 368/220 |
| 4,308,610 | 12/1981 | Walker | 368/220 |
| 4,451,161 | 5/1984 | Muller | 368/220 |
| 4,488,819 | 12/1984 | Schaffner | 368/220 |
| 4,681,464 | 7/1987 | Ray | 368/157 |
| 4,684,263 | 8/1987 | Etienne | 368/220 |

*Primary Examiner*—Vit W. Miska

*Attorney, Agent, or Firm*—Bruce L. Adams; Van C. Wilks

[57] ABSTRACT

A train wheel of an electronic timepiece having more than two motors which drive hand wheels through individual train wheels includes a guide pipe driven and fixed in a bottom plate in the timepiece. The first hand wheel driven by the rotor of the first motor through the first train wheel has a central shaft as its rotational axis. The central shaft of the first hand wheel is inserted into the guide pipe so as to be guided and supported by the inner surface of the guide pipe. The second hand wheel has a central pipe as its rotational axis. The central pipe of the second hand wheel has the guide pipe inserted therein so as to be guided and supported by the outer surface of the guide pipe. Whereby the hand wheels do not come into contact with each other with result that the drive force of one of the hand wheels is not transmitted to the other hand wheel.

6 Claims, 2 Drawing Sheets

TRAIN WHEEL OF ELECTRONIC TIMEPIECE

BACKGROUND OF THE INVENTION

The present invention relates to a train wheel of an electronic timepiece having more than two rotors and two hand wheels, and more particularly to a supporting structure of hand wheels which are driven by the rotors independently of each other.

In the case of an electronic timepiece having two rotors wherein the drive forces from the rotors are transmitted to the hand wheels through individual train wheels, it has been known as shown in FIG. 2, to provide the second train wheel for driving the second hand wheel 14 with the second rotor 15 through the second drive transmitting wheel 16 and the first train wheel for driving the first hand wheel 13 with the first rotor 17 through the first drive transmitting wheel 18. The second hand wheel 14 has a pipe 14*a* defining a rotational axis and the first hand wheel 13*a* has a shaft 13*a* as defining a rotational axis. The shaft 13*a* of the first hand wheel 13 is inserted in the axis pipe 14*a* of the second hand wheel 14 so as to be slidably guided by the inner surface of the pipe 14*a*.

In the case of the above structure, when the first hand wheel 13 is driven to rotate by the first rotor 17, a problem arises that the second hand wheel 14 tends, though slightly, to be rotationally driven resulting in swinging the hand attached to the second hand wheel 14 since the rotational shaft 13*a* of the first hand wheel comes into direct contact with the rotational pipe 14*a* of the first hand wheel.

SUMMARY OF THE INVENTION

It is therefore and object of the invention to provide an improved train wheel which operates the hands accurately without irregularities.

It is another object of the invention to provide a train wheel which prevents the swinging of the hand attached to the wheel which is being driven.

It is further object of the invention to provide is train wheel wherein the drive force of one of the hand wheels is not transmitted to the other hand wheel.

These and other objects of the invention are achieved by a train wheel in which a guide pipe is driven and fixed in a bottom plate and the rotational shaft of the second hand wheel is rotatably inserted into the guide pipe so as to be guided by the inner surface of the guide pipe, whereas the rotational pipe of the first hand wheel has the guide pipe inserted therein so as to be guided by the outer surface of the guide pipe, in order that the hand wheels do not come into direct contact with each other.

With the above structure, where one of the hand wheels is driven while the other is at a standstill, the drive force of the driven hand wheel is not transmitted to the other hand wheel so that the hand attached to the stationary hand wheel dose not swing and the hand attached to the driven hand wheel runs smoothly without being affected by the load from the stationary hand wheel.

DETAILED DESCRIPTION OF THE PREFERRED EMBODIMENT

Figure 1:
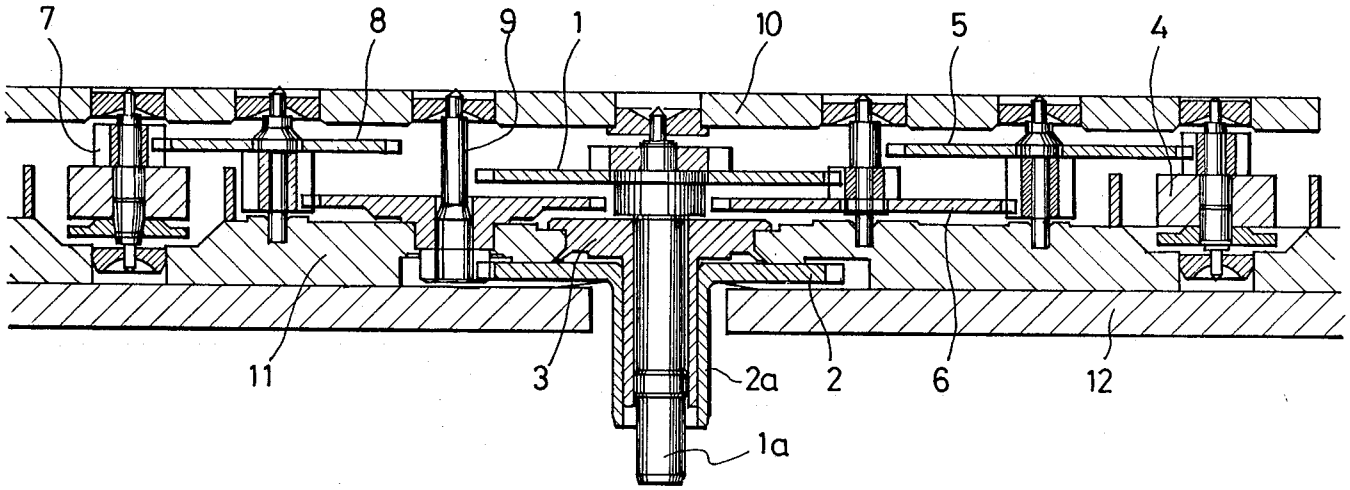
FIG. 1 is a sectional view of train wheel of an electronic timepiece having two rotors.
Figure 2:
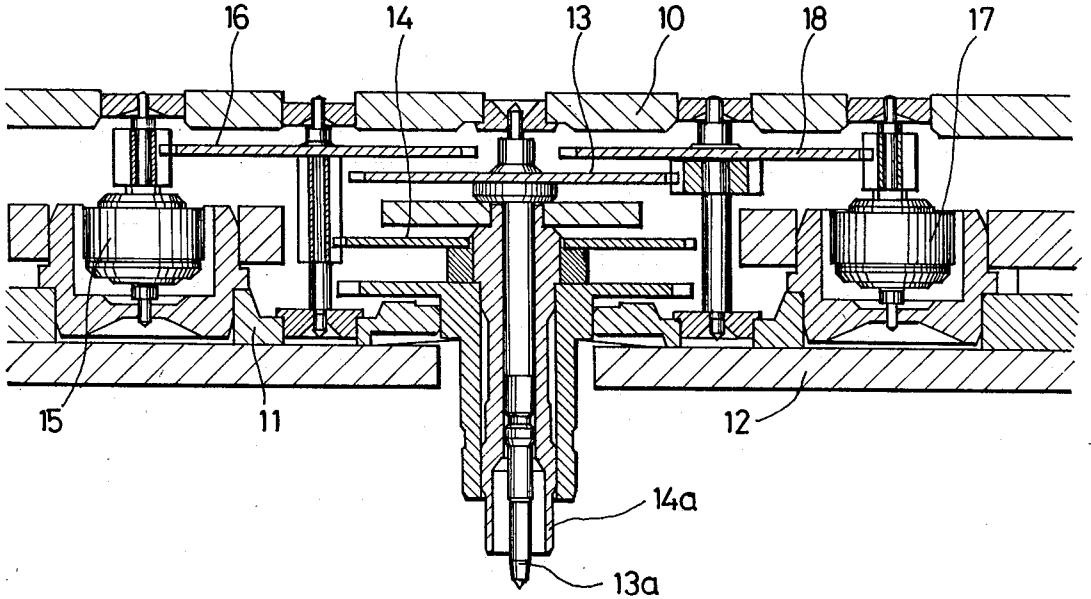
FIG. 2 Prior art
FIG. 2 is a sectional view of a conventional train wheel of an electronic timepiece having two rotors.

One embodiment of the present invention will now be described with reference to the accompanying drawing. In FIG. 1, a first hand wheel 1 is driven by a first rotor 4 as a drive source through drive transmitting wheels 5 and 6 and a second hand wheel 2 is driven by a second rotor 7 as another drive source through drive transmitting wheels 8 and 9. The first hand wheel 1 has a central shaft 1a defining a rotational axis and the second hand wheel 2 has a pipe or tubular portion 2*a* tubular defining a rotational axis. A guide pipe or second member 3 is driven and fixed in a bottom or base plate 11. The rotational shaft 1*a* of the first hand wheel 1 is rotatably inserted into the tubular guide pipe so as to be guided by the inner surface of the guide pipe 3. The pipe portion 2*a* of the second hand wheel is rotatably inserted over the guide pipe 3 so as to be guided by the outer surface of the guide pipe. As shown in FIG. 1, the tubular guide pipe 3 has a radially extending outer flange interposed between flange portions of the shaft 1*a* and pipe portion 2*a*. The tubular guide pipe 3 prevents hand wheels 1 and 2 from coming into direct contact with the each other. The rotors 4 and 7 and transmitting wheels 5,6,8,9 are supported by the bottom plate 11 and a train wheel bridge 10 with sufficient rotational clearances. By such a construction, the first hand wheel 1 is supported by the train wheel bridge 10 and the guide pipe 3 driven in the bottom plate 11 leaving rotational clearances and the second hand wheel 2 is supported and guided by the guide pipe 3 and supported spring by a provided on a dial 12 leaving rotational clearances.

Thus, by inserting the fixed guide pipe 3 between the central shaft 1*a* of the first hand wheel 1 and the pipe portion 2*a* of the second hand wheel 2, the driven hand is not effected by the stationary hand so that the former is not subjected to an unstable load from the later and the hand attached to the former runs smoothly without irregularities. Likewise, since the stationary hand wheel is not affected by the driven hand wheel, the hand attached thereto does not swing. The present invention has such affects that since the hand wheels are held out of direct contact with each other by the guide pipe, the driven hand runs smoothly without irregularities and the shaking of the stationary hand is prevented.

What is claimed is:

1. A train wheel of an electronic timepiece comprising:

a bottom plate;

a first rotor provided on one side of the bottom plate for driving a first hand wheel;

a first train wheel provided on said one side of the bottom plate and rotationally driven by the first rotor for transmitting the driving force of the first rotor to the first hand wheel to rotate the first hand wheel;

the first hand wheel being positioned on said one side of the bottom plate and having a central shaft;

a first hand provided on the central shaft for indicating time information;

a second rotor provided on said one side of the bottom plate for driving a second hand wheel;

a second train wheel provided on said one side of the bottom plate and independently rotationally driven by the second rotor for transmitting the driving force of the second rotor to the second hand wheel to rotate the second hand wheel and having a wheel provided through the bottom plate for transmitting the driving force to the other side of the bottom plate;

the second hand wheel being positioned on said other side of the bottom plate and having a central pipe;

a second hand provided on the central pipe for indicating time information;

a guide pipe extending through the bottom plate;

the central shaft of the first hand wheel being rotatably inserted into the guide pipe from said one side of the bottom plate so as to be guided and supported by the inner surface of the guide pipe; and the central pipe of the second hand being rotatably inserted over the guide pipe from said other side of the bottom plate so as to be guided and supported by the outer surface of the guide pipe.

2. In an electronic timepiece having at least two hands for indicating time information on a dial: a base plate having opposed sides; a first rotationally driven rotor disposed on one side of the base plate; a first rotatable hand wheel having a central shaft extending through an opening into the base plate; a first hand connected to the central shaft for rotation therewith to indicate time information on the dial; a first train of wheels for transmitting rotation of the first rotor to the first hand wheel to thereby rotate the first hand; a second rotationally driven rotor disposed on the one side of the base plate and being rotationally driven independently of the first rotor; a second rotatable hand wheel having a central tubular shaft extending through the opening in the base plate; a second hand connected to the central tubular shaft for rotation therewith to indicate time information on the dial; a second train of wheels for transmitting rotation of the second rotor to the second hand wheel to thereby rotate the second hand; and a tubular guide member extending through the opening in the base plate and having an inner surface portion in rotary sliding contact with the central shaft of the first hand wheel and an outer surface portion in rotary sliding contact with the central tubular shaft of the second hand wheel.

3. An electronic timepiece according to claim 2; wherein the tubular guide member has a radially extending outer flange interposed between a flange portion of the central shaft and a flange portion of the central tubular shaft.

4. An electronic timepiece according to claim 3; wherein the outer flange of the tubular guide member is positioned in the opening in the base plate.

5. An electronic timepiece according to claim 3; wherein the first and second hand wheels are rotatably disposed on opposite sides of the base plate.

6. An electronic timepiece according to claim 2; wherein the first and second hand wheels are rotatably disposed on opposite sides of the base plate.

* * * * *